United States Patent [19]

Davis

[11] Patent Number: 4,969,842

[45] Date of Patent: Nov. 13, 1990

[54] MOLDED ELECTRICAL CONNECTOR HAVING INTEGRAL SPRING CONTACT BEAMS

[75] Inventor: Thomas F. Davis, Camp Hill, Pa.

[73] Assignee: AMP Incorporated, Harrisburg, Pa.

[21] Appl. No.: 443,979

[22] Filed: Nov. 30, 1989

[51] Int. Cl.[5] ..... H01R 9/09

[52] U.S. Cl. ..... 439/629; 439/886

[58] Field of Search ..... 439/629–637, 439/886

[56] References Cited

U.S. PATENT DOCUMENTS

| | | | |
|---|---|---|---|
| 3,042,591 | 7/1962 | Cado | 204/15 |
| 3,475,186 | 10/1969 | Dutkewych | 106/1 |
| 4,529,257 | 7/1985 | Goodman et al. | 339/94 |
| 4,532,152 | 7/1985 | Elarde | 427/96 |
| 4,604,799 | 8/1986 | Gurol | 29/897 |
| 4,737,118 | 4/1988 | Lockard | 439/289 |
| 4,820,170 | 4/1989 | Redmond et al. | 439/66 |
| 4,838,799 | 6/1989 | Tondoka | 439/886 |

OTHER PUBLICATIONS

O'Brien, Jack "Casting Spring"-A Plated, Molded Thermoplastic Electrical I/O Interface, *Connection Technology,* vol. 5, No. 6, Jun. 1989, pp. 23–27.

*Primary Examiner*—Joseph H. McGlynn

*Attorney, Agent, or Firm*—Katherine A. Nelson

[57] ABSTRACT

The molded connector 10 includes a dielectric housing 12 having a transverse wall 14 with a plurality of apertures 20 extending therethrough and first and second molded sections 24, 32 extending outwardly from the periphery of and at opposite ends of respective apertures 20, the corresponding first and second molded sections 24, 32 being associated with each other and including first surface portions 26, 34 extending continuously from a common sidewall 22 of the respective aperture 20. The first and second molded sections 24, 32 include an inner dielectric core integrally molded with the housing wall 14 and at least one layer 40 of plating disposed on first surface portions 26, 34 thereof and along the respective common aperture sidewall 22 thereby defining first and second contact sections 42, 46 connected by a continuous conductive surface 44 extending therebetween. The first and second molded sections 24, 42 are adapted to interconnect first and second contact means in engagement with the first and second contact sections 42, 46 respectively. In the preferred embodiment at least one contact section is a compliant beam and the plating thereon strengthens the beam such that the beam provides sufficient compression force to maintain electrical contact with a mating article without the need for elastomeric support.

9 Claims, 5 Drawing Sheets

MOLDED ELECTRICAL CONNECTOR HAVING INTEGRAL SPRING CONTACT BEAMS

FIELD OF THE INVENTION

The present invention is directed to electrical connectors and in particular to molded connectors having the beam members for interconnecting conductors on surface of a substrate.

BACKGROUND OF THE INVENTION

As both complexity and miniaturization of electronic devices increase, the need for smaller size, lighter weight packaging and reliability has generated the need for connectors having the ability to reliably connect a large number of electrically conductive traces on closely spaced centerlines in compact areas. Furthermore, there are a number of electronic devices that utilize liquid crystal display units, and circuitry on glass panels and the like that cannot be electrically connected by means of individually soldered connections.

The requirements of the industry have generated a class of connectors known as elastomeric connectors, which can be disposed between circuitry on for example a printed circuit board and also on a glass panel to interconnect to corresponding circuits while avoiding the use of solder. The elastomeric member provides sufficient normal force to maintain the electrical interconnection of the circuits yet the member has sufficient compliancy so as not to damage the glass or other panels.

U.S. Pat. No. 4,820,170 discloses one such layered elastomeric connector in which succeeding layers of dielectric material and conductive material are alternated so as to provide a plurality of closely spaced but electrically isolated conductive areas. Typically the elastomeric connector is a rectangular block such that each layer is exposed on all four sides of the block, thus enabling interconnection between circuits on parallel planes or between circuits on planes that meet at essentially right angles. Since the elastomeric connector is compressible and will expand outwardly when subjected to pressure, means must be provided to support the elastomeric block in order to control the direction of expansion and maintain the block in appropriate alignment and to provide dimensioned stability for the block. In using such an elastomeric connector, therefore, a separate support housing or a special cavity within a connector housing is required. These additional parts for providing interconnection add to the number of pieces that must be molded or otherwise formed in order to achieve and maintain the desired interconnection.

U.S. patent application Ser. No. 07/407,762 owned by the same assignee as the present invention discloses a molded member having an array of compliant spring arms with conductors disposed thereon for electrical engagement with an array of conductors on the surface of a substrate. An elastomeric member is used to support the spring arm portions and to provide resistance to compression to minimize stress on the compliant spring portions and to resist the tendency of the polymeric material to "creep" and "stress relax."

U.S. patent application Ser. No. 444,577 filed Nov. 30, 1989 and owned by the same assignee as the present invention discloses a multicircuit connector assembly for interconnecting an array of conductors of a first article with a corresponding array of conductors of a second article. The connector includes a plurality of bifurcated tines joined by a bight section, each tine having arm portions deflectable toward each other, compressible support means extending between the arm portions of the tines and continuous circuit means defined along the outer surfaces of the tine arms and bight section. The compressible support means has sufficient durometer to maintain contact normal force between the continuous circuit means and the corresponding contact means of opposed first and second electrical articles upon the arm portions being compressively held between the pair of electrical articles.

The use of compliant spring arm contact members for providing surface mounting for components to surfaces such as circuit boards is known. Typically these compliant spring arm members are made of metal that has been stamped and formed into the desired configuration.

While the metal members can be selected to minimize stress relaxation the number of manufacturing and assembly steps required to make a connector with metal members are greater than those associated with the molded assembly previously described.

To obtain the proper spring and other mechanical characteristics the metal members are typically stamped from copper alloys, which are relatively hard materials. These materials are difficult to form and cause problems in stamping since they wear out the stamping tools, thereby increasing the costs of maintaining the tooling. Dead soft copper, on the other hand, is relatively easy to stamp, form and plate but the desired mechanical and spring characteristics suffer. It is desirable, therefore, to have a means for making spring contact arms that have the desired mechanical characteristics and electrical capabilities while minimizing tooling and maintenance costs.

It is desirable, therefore, to provide a means for making connector assemblies with a minimum number of parts.

It is further desirable to minimize the steps in manufacturing such an assembly.

It is also desirable to have an assembly that is relatively lightweight and compact while maintaining the desired electronic capabilities of the more complex prior art devices.

Additionally, it is desirable to have a compliant spring arm section formed essentially of dielectric material that provides sufficient compression force to maintain electrical contact with the conductors of the mating article without the need for an elastomeric support.

Furthermore, it is desirable to maintain the features of spring contacts while eliminating stamping and forming steps required for metal members thus providing a cost effective method for manufacturing.

SUMMARY OF THE INVENTION

Accordingly, the present invention is directed to a connector that alleviates the disadvantages and problems of the prior art. The connector includes a molded dielectric body having a plurality of compliant spring fingers molded integrally therewith, the spring fingers include contact means comprising at least one layer of plating disposed thereon for electrical engagement with a mating article. In the preferred embodiment the plating layer also provides mechanical strength to an arcuate convex section of the spring fingers to maintain contact normal force with a mating contact surface.

The invention is shown representatively as a card edge connector.

The connector of the preferred embodiment comprises a dielectric housing including a transverse wall having a plurality of apertures extending therethrough and first and second molded sections extending outwardly from first and second sides of the wall and extending from the periphery of and at opposite ends of a respective aperture, the corresponding first and second molded sections being associated with each other and including first surface portions extending continuously from a common sidewall of the respective aperture. The first and second molded sections include an inner dielectric core integrally molded with the housing wall and at least one layer of plating disposed on first surface portions thereof and along the respective common aperture sidewall thereby defining first and second contact sections connected by a continuous conductive surface extending therebetween. The first and second molded sections are adapted to interconnect first and second contact means in engagement with the first and second contact sections respectively.

The respective molded sections are clad first with a thin layer of electroless copper then with a thicker layer of desired metal and finally they may be plated with gold or tin. In accordance with the invention, the primary plating layer for the molded members is a nickel-iron alloy having a thickness from about 0.01 to about 0.10 millimeters, preferably 0.02 to 0.05 millimeters. The primary layer provides mechanical strength to the molded sections. For purposes of this application the term "mechanical plating layer" will refer to the primary plating layer. A thin layer of nickel is plated over the alloy to minimize any oxidation of the iron in the alloy. In the embodiment shown, the first contact section is a compliant beam and the second contact is a solder post. The mechanical plating layer provides sufficient strength to the compliant beams to maintain contact normal force without the need for an additional elastomeric member. Since the second contact section is to be soldered, it is preferable that a layer of tin be plated over the nickel. If desired, gold may be selectively plated on the contact area of the first contact section.

It is an object of the present invention to provide a molded connector having compliant beam portions that have the characteristics typically associated with similar metal numbers, such as good elastic properties, high spring rates and minimal stress relaxation.

It is another object of the invention to provide connectors with compliant beam portions in a manner that reduces costs associated with tool maintenance.

It is a further object of the present invention to provide a means for making electrical connectors and assemblies having a minimum number of parts.

It is an additional object of the invention to provide a cost effective means to manufacture such connectors and assemblies.

It is another object of the invention to provide a molded connector member that maintains electrical interconnections even at elevated temperatures.

A further object of the invention is to provide a connector having an integrally formed compliant portion for electrical engagement circuitry on LCDs and the like.

The invention itself, together with further objects and attendant advantages of the invention will be best understood by reference to the following detailed description, taken in conjunction with the accompanying drawing.

BRIEF DESCRIPTION OF THE DRAWING

FIG. 3 is an enlarged fragmentary cross sectional view of the housing wall showing portions of the molded members extending therefrom and the aperture extending therebetween and illustrating the initial layer of plating;

FIG. 4 is a view similar to that of FIG. 3 showing the primary layer of plating;

FIG. 5 is a view of similar to that of FIG. 3 showing a further layer of plating;

DETAILED DESCRIPTION OF THE PREFERRED EMBODIMENT

Figure 1:
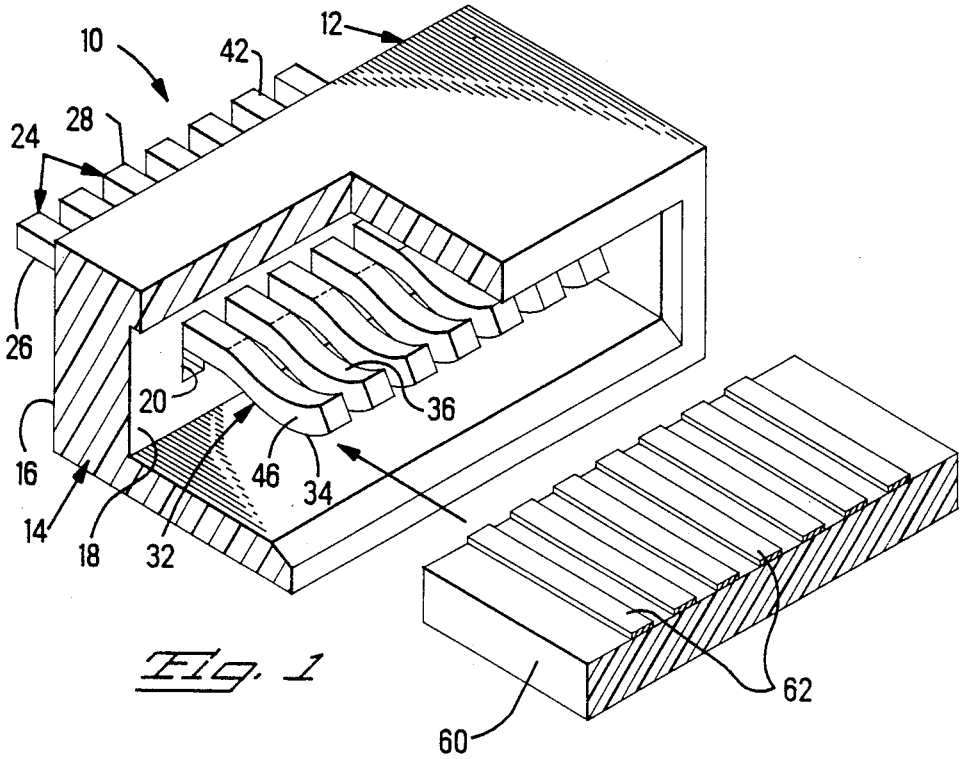
FIG. 1 is a perspective view of a representative connector made in accordance with the invention, the connector being in alignment for receiving and mating with corresponding conductors of a circuit board.
Figure 2:
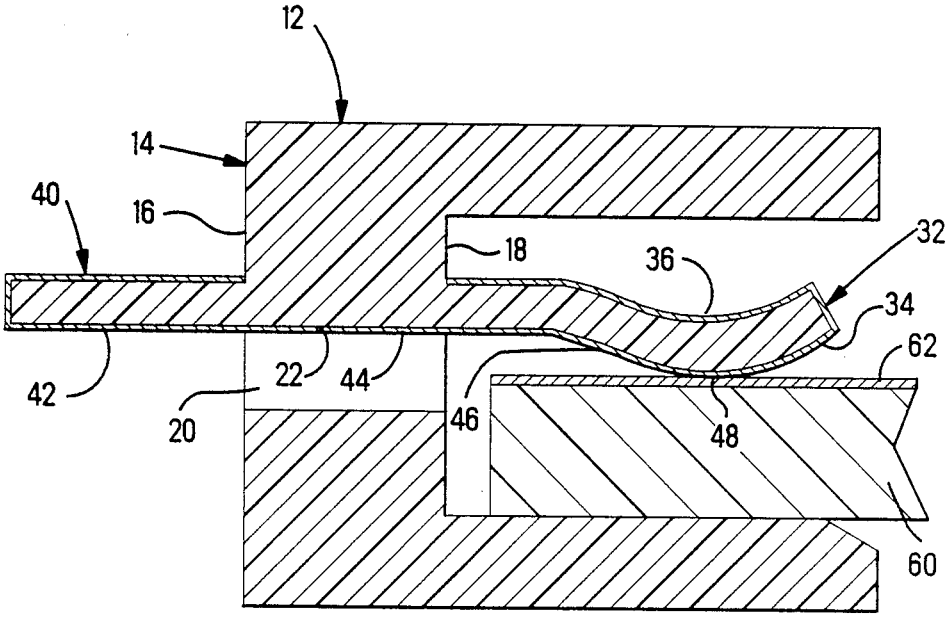
FIG. 2 is a cross sectional view of the connector of FIG. 1, illustrating a contact portion thereof electrically interconnected to a corresponding circuit board conductor.

FIGS. 1 and 2 illustrate a representative molded connector 10 made in accordance with the present invention. Molded electrical connector 10 comprises dielectric housing 12 including a transverse wall 14 having a plurality of apertures 20 extending therethrough and a plurality of associated first and second contact sections 46, 42 extending outwardly from opposite peripheral edges of respective apertures 20, the first and second contact sections being adapted to electrically engage with corresponding contact means of first and second electrical articles. For purposes of illustration, contact sections 46, 42 are shown as compliant beam contacts and pin contacts respectively. Only one electrical article, circuit board 60 having conductors 62 thereon for electrical engagement with second contact section 46 is shown in FIGS. 1 and 2.

As shown in these Figures, apertures 20 extend through transverse wall 14 from a first side 16 to a second side 18 thereof. A plurality of opposed first and second molded sections 32, 24 extend from opposed first and second sides 18, 16 of said transverse wall 14. A plurality of second molded sections 24 extend outwardly from second side 16 of wall 14, each section 24 extending from the periphery of a respective one of apertures 20. Second molded sections 24 include first and second surface portions 26, 28 respectively. A plurality of first molded sections 32 extend outwardly from first side 18 of wall 14, each first section 32 extending from the periphery of a respective one of apertures 20. First molded sections 32 include first and second surface portions 34, 36 respectively. First molded sections 32 include arcuate free ends convex in a first lateral direction along first surface portions 34 of first molded members 32. Corresponding first and second molded sections 32, 24 are associated with each other and their respective first surface portions 34, 26 extend continuously from a common sidewall 22 of the respective aperture 20. In the preferred embodiment, first and second molded sections 32, 24 are integrally molded with wall 14 of connector housing 12 and form dielectric cores for respective first and second contact sections 46, 42, as more fully described below.

As best seen in FIG. 2, first and second molded sections 32, 24 include at least one layer of plating 40 disposed on first surface portions 34, 26 thereof and along common sidewall 22 of the respective aperture 20, thereby defining first and second contact sections 46, 42 connected by a continuous conductive surface 44 extending therebetween. The continuous conductive surface includes the convex surface of the arcuate free ends of the second molded section 32. The first and second molded sections 32, 24 are adapted thereby to interconnect first and second contact means in engagement with said first and second contact sections 46, 42 respectively. In the preferred embodiment all surfaces of the outwardly extending first and second molded sections 32, 24 are covered with plating material.

Figure 3:
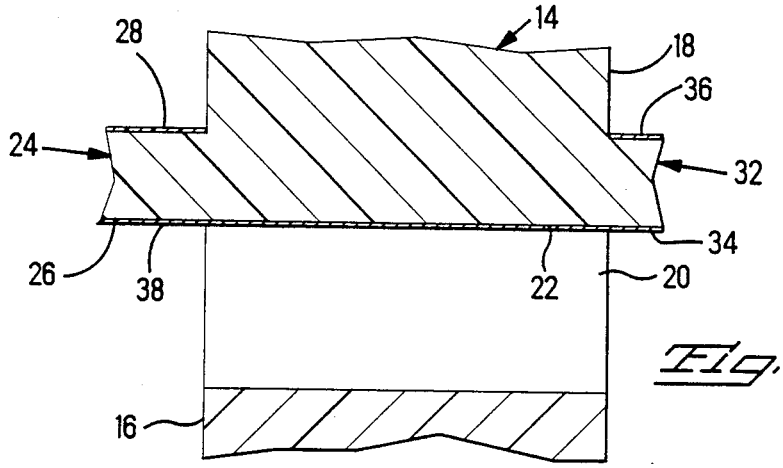
FIGS. 3–5 illustrate the steps in plating the molded sections that define the contact sections of the connector.
Figure 4:
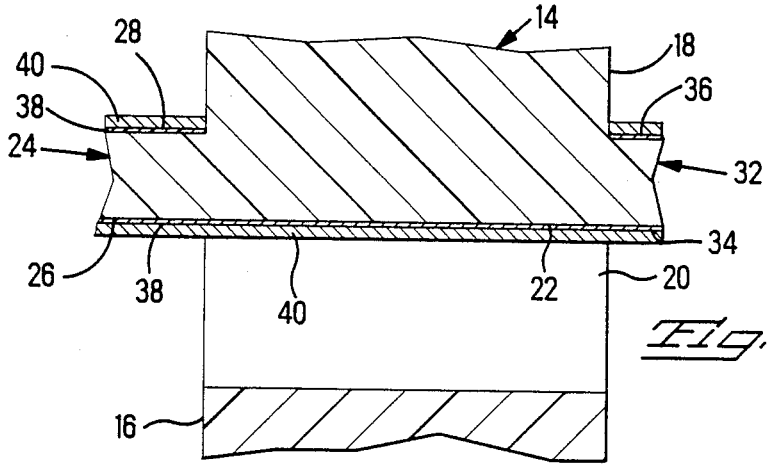
Figure 5:
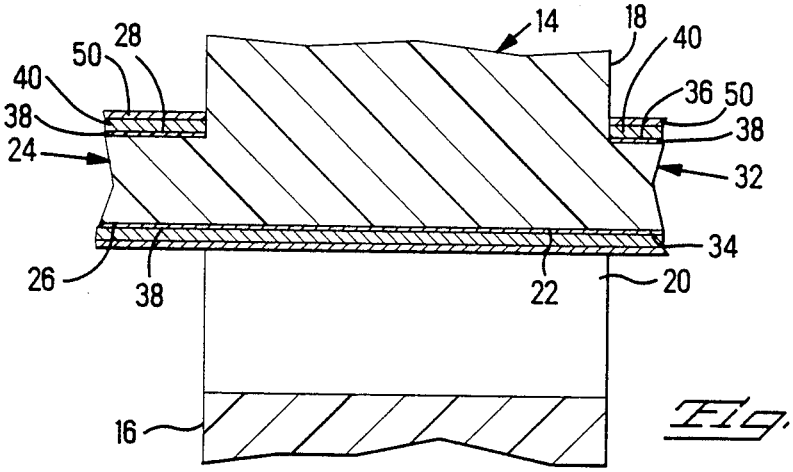

For purposes of illustration, FIG. 2 shows a continuous "single" layer of plating. Details of the preferred sequence of plating layers for dielectric sections 24, 32 and aperture surface 22 for the preferred embodiment is further illustrated in FIGS. 3–5. In accordance with known plating procedures for plating plastics, the plating layer includes at least two layers, an initial thin layer 38 about one micron thick of electroless copper disposed on the desired surfaces to promote adhesion of subsequent plating layers and a thicker layer 40 of the primary or mechanical plating material deposited on the copper layer 38. This thicker layer of plating provides the mechanical properties to the plastic members. The plating material for layer 40 in the preferred embodiment is a nickel-iron alloy, which is deposited in a layer having a thickness from about 0.01 to about 0.10 millimeters, and more preferably from 0.02 to about 0.05 millimeters. To minimize oxidation of the iron, a thin layer 50 of nickel having a thickness of about 0.001 to about 0.002 millimeters may then be deposited over the alloy. The three layers 38, 40 and 50 are preferably plated on at least the first surface portions 26, 34 of the first and second molded portions 32, 24 and the aperture sidewall 22 extending therebetween. Preferably the three layers extend along the remaining surfaces of the first and second molded portions as well.

In addition to these layers, the first and second contact sections 46, 42 may be further plated depending upon the design and end use of the connector 10. For example if a contact is to be soldered, a layer of tin or tin-lead is typically plated over the nickel to provide a solderable surface for a tin-lead solder. In the embodiment shown in FIG. 2, the first contact section 46 is a compliant beam having convex contact area 48 on its free end for electrically engaging conductor 62 on circuit board 60. In the preferred embodiment, contact area 48 of first contact section 46 is selectively plated with gold, which maintains a stable contact resistance over the life of the product.

It is to be understood that the configuration of the connector shown in FIG. 1 is for purposes of illustration only and that modifications may be made without departing from the basic spirit of the present invention.

In the preferred embodiment housing member 12 and integrally formed first and second sections 32, 24 are molded from a suitable dielectric material such as for example, acrylonitrile-butadiene-styrene copolymer, available, for example, from Borg-Warner Chemicals, Inc. under the trade name CYCOLAC; polyphenylene sulfide available from Phillips 66 Company under the trade name as RYTON R-4 or liquid crystal polymer available from Celanese Speciality Resins, Inc. under the trade name VECTRA A130. Since the dielectric material is used primarily as a means for producing the desired shape for receiving plating layers, the main factors to be considered in selecting suitable molding materials include the platability of the material and the operating temperature to which the connector will be subjected. The shape and thickness of the dielectric contact beams will also be influenced by demands of the molding process. The mechanical characteristics of the contact sections made in accordance with the invention depend primarily on the plating materials used. The material selected for the mechanical plating layer needs to have good adherence to plastic materials, have high strength characteristics, good electrical properties and minimum relaxation under stress. In addition the material should be readily platable in a controllable plating process. In accordance with the invention, the thickness of the inner dielectric core is about 0.65 millimeters and in combination with a 0.05 millimeter layer of mechanical plating above and below the beam results in a reinforced beam of about 0.75 millimeters. The thickness of the finished beam can, of course, be altered by adjusting the thicknesses of the core and plating layers.

After molding the connector body with the integral contact sections, an initial one micron thick layer of copper is electrolessly deposited on the surface of the entire connector housing 12, since an electrically conductive surface is desired for subsequent electroplating steps. To eliminate confusion, the layer 38 of copper in FIGS. 3–5 has been shown only on those surfaces that will receive further plating. The copper layer is used to promote adhesion of the subsequent plating layers. A number of electroless plating systems are commercially available. One such system is available from Enthone, Inc., Westhaven, Conn. The process may be summarized as follows. The article to be plated is first cleaned preferably in an alkali cleaning solution, to remove any oil that may be on the treated surface. A suitable cleaning solution is ENPLATE Z-72. The connector is rinsed under running water, and etched in a chrome-sulfuric acid bath. Immersion in a 20% hydrochloric acid solution to remove any remaining etch solution. The part is then immersed in a palladium catalyst solution. The solution used was a hydrochloric acid solution containing tin and palladium chlorides which allows for a colloidal deposition of elemental platinum on the plastic while converting tin ions from stannous to stannic. The article is rinsed and treated with a formic acid solution to eliminate any remaining traces of palladium ion which will cause the decomposition of the electroless copper solution. After again rinsing the article, the article is placed in an electroless copper solution until an approximately one micron thick layer of copper is deposited. A typical electroless copper plating solution has the following composition:

| | |
|---|---|
| Copper sulfate - $5H_2O$ | 10 g/L |
| Sodium hydroxide | 10 g/L |
| Formic acid (37%) | 20 ml/L |
| EDTA (tetrasodium salt of ethylene diaminetetraacetic acid) | 20 g/L |
| Methyldichlorosilane | 0.25 g/L |
| Temperature | 65° C. (143° F.) |

Further details of this bath are found in U.S. Pat. No. 3,475,186.

The plated article is then rinsed, preferably dried in the oven at 110° C. for about an hour and allowed to rest at room temperature for about 24 hours before further plating.

After the initial plating has been completed the copper coated surfaces of the connector housing that will not be receiving further plating are coated with plating resist by conventional means. The remaining exposed areas that form the contact sections and the intervening aperture surfaces therebetween are then electrolytically plated with the desired metal for providing mechanical strengthening and the desired finishing layers using commercially available plating chemistry. In the preferred embodiment the mechanical plating layer is nickel-iron alloy. The resist is then removed such as with solvent, thereby exposing the "unplated" copper layer. The exposed copper layer is removed from the surfaces of the connector by etching process as known in the art. Baking or other post-curing restoration steps and cleaning steps may optionally be utilized. Other methods as known in the art may also be used to dispose conductive material on the desired areas of the molded housing.

Figure 6:
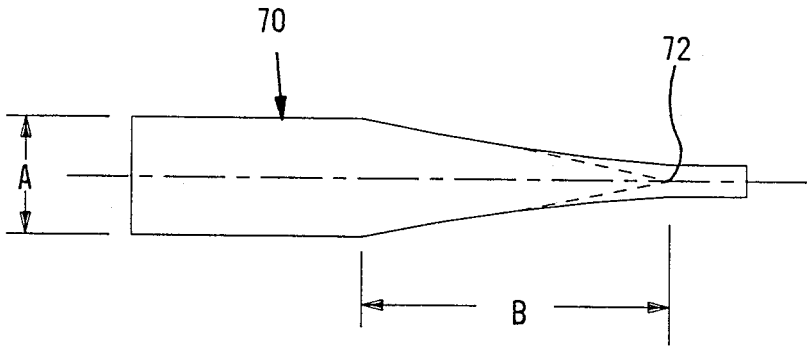
FIG. 6 is a plan view of the sample beam made in accordance with the invention and used for determining load characteristics of a plated plastic beam.

The following procedures were followed to test and compare various plating materials to determine which one or ones provided the desired mechanical properties to the beam members. Sample tapered beams 70 having the shape shown in FIG. 6 were machined from 1.59 millimeter thick, 12.7 millimeter wide bars molded from CYCOLAC T4500, an acrylonitrile-butadiene-styrene resin available form Borg-Warner. The sample beams 70 were cut to a length of about 65 millimeters and a triangular shape was marked on the surface. The broken lines in FIG. 6 show the triangular shape on the beam with the apex at 72. In shaping the beam, an extension was cut at the apex to provide sufficient surface for applying a load L at apex 72. The length B of the triangle was about 32 millimeters and the width A of the base was 12.7 millimeters.

The sample tapered beams were all treated for adhesion promotion and plated with a 1 micron thick layer of electroless copper in accordance with known plating techniques. The plating system used for the sample beams was the ENPLATE system available from Enthone, Inc. ENPLATE is a registered trademark of Enthone, Inc. The following steps were followed in treating and plating the connector surface with electrolessly deposited copper.

(a) The molded beam samples were cleaned in ENPLATE Z-72 alkaline soak cleaner for 5 minutes at 65° C. and rinsed with water.

(b) The beam samples were etched at 65° C. for 8 minutes in a chrome-sulfuric acid bath comprising an aqueous solution having 420 grams/liter chromic acid, 20% by volume sulfuric acid and 1% by volume ENPLATE Q519, an additive for promoting wetting. Excess chromic acid was removed and the samples were rinsed with water.

(c) The etched beam samples were then dipped in a 20% hydrochloric acid solution for one minute.

(d) The beam samples were catalyzed with ENPLATE 444, a one-step palladium catalyst solution, for four minutes at room temperature and rinsed with water.

(e) The beam samples were immersed in ENPLATE 492, an accelerator comprising a formic acid solution, for four minutes and rinsed with water.

(f) The beam samples were immersed in an Enthone electroless Copper bath 872 at 41°–43° C. for about 20 minutes during which time a layer of copper about 1 micron thick was deposited on the surface.

(g) The plated beam samples were rinsed with water and then oven dried for 1 hour at 110° C.

(h) In accordance with standard procedure, the plated beam samples were allowed to rest for a minimum of 24 hours before being subjected to further plating. The copper coated beam samples were then subjected to further plating as described below.

The present invention will now be described in detail by reference to the following examples. They are illustrative only and are not to be construed to limit the invention in any manner whatsoever.

EXAMPLE 1

Figure 8:
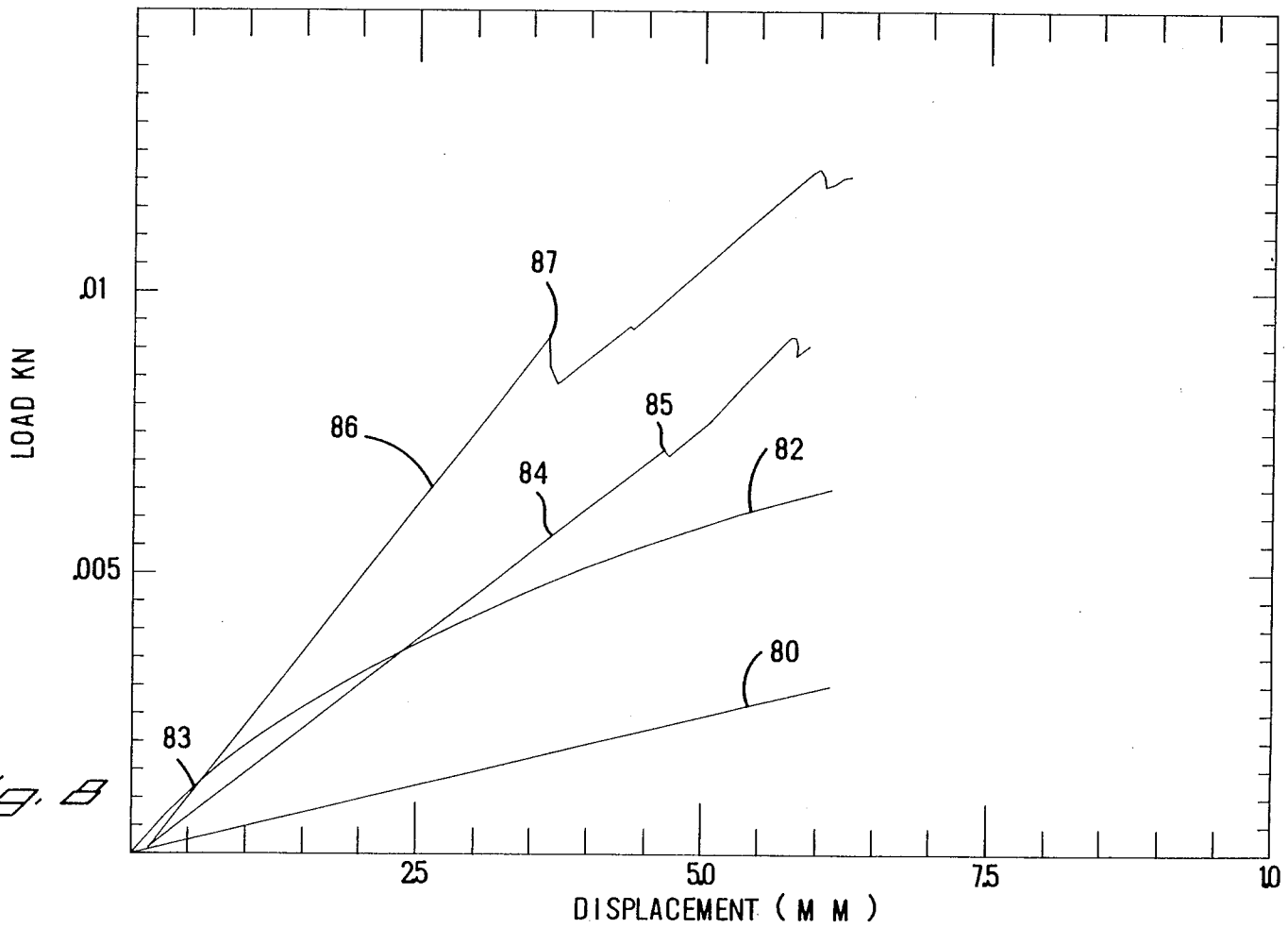
FIG. 8 is a graph showing the displacement of sample beams of FIG. 7 under increasing load and a comparison of the curves for unplated and plated beams.

Some beam samples were electroplated with various thickness of copper using standard copper planting bath ENPLATE HT available from Enthone, Inc. The samples were immersed in the bath at 21°–27° C., 2.5 amps per square decimeter (ASD) for about 21 minutes for a 12.18 micrometer thick deposit; 42 minutes for a 24.87 micrometer deposit and about 55 minutes for a 31.98 micrometer deposit. The load/ deflection test results for one of each of these samples are given in Table 1. The load/deflection curve for one of these samples is shown in the graph of FIG. 8.

EXAMPLE 2

Other beam samples were plated with various thickness of electroless nickel using standard electroless nickel planting bath ENPLATE NI-433 available from Enthone, Inc. Prior to immersion in this bath the samples were pretreated in ENPLATE 440 at room temperature for 20 seconds and rinsed. The samples were then immersed in the bath at 79° C., for about 60 minutes for a 12.44 micrometer thick deposit and 120 minutes for a 25.4 micrometer deposit. The load/ deflection test results for one of each of these samples are given in Table 1.

EXAMPLE 3

Some beam samples were electroplated with various thickness of nickel using a standard sulfamate nickel planting bath having 84 grams per liter total nickel. The bath was comprised of 450 grams per liter nickel sulfamate, and 37.5 grams per liter boric acid. The samples were immersed in the bath at 60° C., 3 (ASD) for about 20 minutes for a 10.91 micrometer thick deposit and about 40 minutes for a 23.35 micrometer deposit. The load/ deflection test results for one of each of these samples are given in Table 1.

EXAMPLE 4

Figure 9:
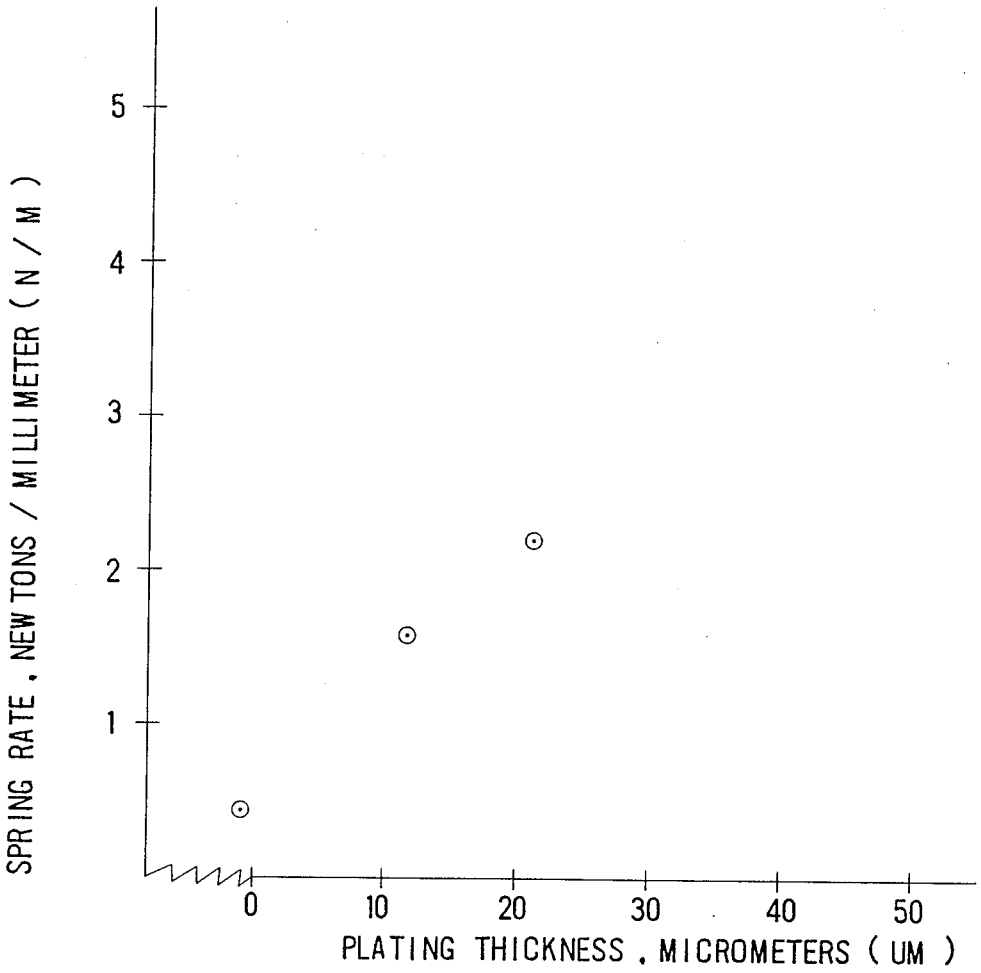
FIG. 9 is a graph showing the effect of increasing the thickness of the mechanical layer of nickel-iron plating on the spring rate of the beam of FIG. 7.

Other beam samples were electroplated with various thickness of nickel-iron alloy using standard nickel-iron planting bath M&T Nickel-iron III, available from M&T Chemicals, Inc. The samples were immersed in the bath at 54° C., 3 (ASD) for about 20 minutes for an 11.93 micrometer thick deposit and about 40 minutes for a 21.32 micrometer deposit. The load/ deflection test results for one of each of these samples are given in Table 1. The load/deflection curve for one of each of these samples is shown in the graph of FIG. 8. The graph of FIG. 9 shows the spring rate vs. plating thickness of nickel-iron beam samples.

TEST PROCEDURE

After the various groups of sample beams had received the desired plating, the beams were tested in an Instron Testing Machine to compare the spring rates for the different platings and different plating thicknesses. The method used is similar to ASTM Method D747-83, "*Stiffness of Plastics by Means of a Cantilevered Beam*", in which an increasing load is placed on a cantilevered beam near its free end and the resulting deflection is measured. The relative stiffness of various materials can thereby be compared.

Figure 7:
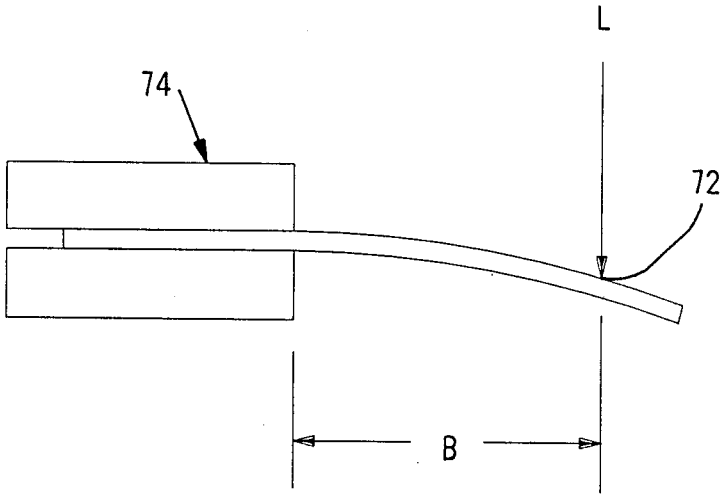
FIG. 7 is a cross sectional view of a plated sample beam being subjected to a load.

In testing the present samples, the wider end of the beam was inserted into and held by a vice 74, such that the tapered portion becomes a cantilevered beam, as shown in FIG. 7. In the tests of the above described samples the load was applied at the apex 72 of the triangle shown in FIG. 6. The load was increased gradually until the beam deflected 6.09 millimeters and the results were recorded in the Instron Series IX data acquisition system. The test was repeated three times on each sample. The tabulated results of the tests are given in Table 1 below. The spring rate is the slope of the initial straight portion of the load deflection trace. The proportional limit is the maximum load for the beam which occurs at the point the deflection trace ceases to be a straight line. The curving of the line indicates the plating layer is beginning to yield and plastically deform. Samples which exceeded their proportional limits during the testing did not return to their original horizontal position after the load was removed, but remained in a slightly bowed condition. A sample was considered to be elastic if it returned to a horizontal position after the load was removed and the load/deflection curve remained a straight line. Unplated beam samples were also tested in the same manner as the plated beam samples. The results are included in Table 1.

TABLE 1

| | Load/Deflection Test Results | | | |
|---|---|---|---|---|
| Sample No. | Kind of Plating | Plating Thickness (μM) | Spring Rate (N/mm) | Proportional Limit (N) |
| 1 | None | — | 0.50 | Elastic |
| | | | 0.50 | Elastic |
| 2 | Copper | 12.18 | 1.38 | 0.58 |
| | | | 1.40 | 1.56 |
| | | | 1.40 | 1.56 |
| 3 | Copper | 24.87 | 2.10 | 0.98 |
| | | | 2.10 | 1.91 |
| | | | 2.10 | 1.91 |
| 4 | Copper | 31.98 | 3.08 | 0.67 |
| | | | 2.98 | 2.14 |
| 5 | Electroless Nickel | 12.44 | 1.55 | Elastic[1] |
| 6 | Electroless Nickel | 25.4 | 2.45 | Elastic[1] |
| 7 | Sulfamate Nickel | 10.91 | 1.13 | 1.91 |
| | | | 1.13 | 4.09 |
| | | | 1.06 | 3.78 |
| 8 | Sulfamate Nickel | 23.35 | 2.33 | 2.22 |
| | | | 2.51 | 8.0 |
| | | | 2.56 | 6.67 |
| 9 | Nickel- | 11.93 | 1.60 | Elastic |

TABLE 1-continued

| | Load/Deflection Test Results | | | |
|---|---|---|---|---|
| Sample No. | Kind of Plating | Plating Thickness (μM) | Spring Rate (N/mm) | Proportional Limit (N) |
| | Iron | | 1.62 | Elastic |
| | | | 1.62 | Elastic |
| 10 | | 21.32 | 2.23 | Elastic |
| | | | 2.06 | Elastic |
| | | | 2.04 | Elastic |

Cracks occurred in the plating for all samples tested.

FIG. 8 is a graph showing the load-deflection curves for the initial loading for four of the above samples. Line 80 shows the results for unplated plastic beams, sample 1; line 82 the curve for a copper plated beam, sample 3; and lines 84, 86 are for nickel-iron plated beams, samples 9 and 10 respectively. Line 80 is a straight line, which indicates the elasticity of the unplated plastic sample. Line 82, on the other hand, remains straight for only a short distance and at 83 begins to curve indicating that the proportional limit has been reached and the copper plated sample has been permanently deformed. Lines 84 and 86 for the nickel-iron are also straight lines indicating the elasticity of these samples. The sharp breaks 85, 87 in the straight lines indicate a buckling of the plating on the compressed surface as the load is increased. The graph in FIG. 9 compares the spring rate of nickel-iron samples having different thicknesses of plating and shows that the spring rate increases as the thickness of the plating layer increases.

As can be clearly seen from the above table and the graph of FIG. 8, the load deflection behavior of a plastic beam having a metal layer plated on the surfaces thereof is improved by the addition of the metal and the plated beam is capable of withstanding a much greater load than an unplated beam. The graph of FIG. 8 and the results given in Table 1 clearly show that a plated layer of a nickel-iron alloy outperforms the other materials, such as copper, electroless nickel, and sulfamate nickel. While the copper plated samples 2, 3 and 4 and the samples plated with the nickel sulfamate bath , samples 7 and 8 show a higher initial spring rate than the nickel-iron plated samples 9 and 10, the low yield strengths of samples 2–4, 7 and 8, shows that the samples are permanently deformed under a slight deflection. The proportional limit of sample 3 of the copper plated beam is indicated at 83. The nickel-iron coated beams, on the other hand, remained elastic throughout the test procedure. The resulting nickel-iron beam has spring characteristics one hundred times that of the unplated beam as shown in the graph of FIG. 8.

The present invention provides a compact structure for an electrical connector having a minimum number of parts and one that is cost effective to manufacture. The connector is a member having integrally formed first and second dielectric members having plating disposed thereon thereby forming contact sections and means for electrically interconnecting associated ones of the first and second contact sections, thus eliminating the need for separate metal conductors. The plating provides strength to plastic beam members and eliminates the need for elastomeric support members. From the tests conducted thus far, it appears that a reinforced plated beam having a combined thickness 0.75 millimeters ( 0.65 millimeter thick dielectric beam having a 0.05 millimeter thick layer of nickel-iron plating on its two major surfaces) has spring and other mechanical characteristics that are essentially equivalent to those of a phosphor bronze metal beam having a thickness of 0.70 millimeters. The resultant compliant spring arm section formed essentially of dielectric material provides sufficient compression force to maintain electrical contact with the conductors of the mating article without the need for an elastomeric support.

Accordingly, it will be appreciated by those skilled in the art that the improved electronic assembly of the present invention provides both compactness or miniaturization while facilitating cost effective production methods.

It is thought that the electronic assembly of the present invention and many of its attendant advantages will be understood from the foregoing description. Changes may be made in a form, construction and arrangement of parts thereof without departing from the spirit and scope of the invention or sacrificing all of its material advantages.

I claim:

1. A molded electrical connector comprising:

dielectric housing including a transverse wall having at least one aperture extending therethrough from a first to a second side thereof;

at least one first molded section extending outwardly from said first side of said wall and extending from the periphery of a respective said aperture; and at least one second molded section extending outwardly from said second side of said wall and extending from the periphery of said aperture, each said first and second molded section being associated with each other and including first surface portions extending continuously from a common sidewall of said respective aperture;

each said first and second molded sections including an inner dielectric core integrally molded with said wall of said housing and at least one layer of plating disposed on said first surface portions thereof and along said common sidewall thereby defining first and second contact sections connected by a continuous conductive surface extending therebetween; whereby said first and second molded sections are adapted to interconnect first and second contact means in engagement with said first and second contact sections respectively.

2. The connector of claim 1 wherein said at least one first molded section includes an arcuate free end convex in a first lateral direction along said first surface portion.

3. The connector of claim 2 wherein said continuous conductive surface includes the plated convex surface of said arcuate free end of said first molded section, said first molded section defining a spring beam deflectable at said arcuate free end in a second direction opposed from said first direction upon deflectable engagement with corresponding contact means of a mating electrical article, said at least one plating layer providing mechanical strength at least to said arcuate end of said spring beam thereby reducing the stress relaxation of said spring beam.

4. The connector of claim 1 wherein said at least one layer of plating comprises a nickel-iron alloy.

5. A molded electrical connector comprising:

dielectric housing including a transverse wall having a plurality of apertures extending therethrough from a first to a second side thereof;

a plurality of first molded sections extending outwardly from said first side of said wall and extending from the periphery of respective ones of said apertures; and a plurality of second molded sections extending outwardly from said second side of said wall and extending from the periphery of respective ones of said apertures, corresponding ones of said first and second molded sections being associated with each other and including first surface portions extending continuously from a common sidewall of respective ones of said apertures;

each said first and second molded sections including an inner dielectric core integrally molded with said wall of said housing and at least one layer of plating disposed on said first surface portions thereof and along said common sidewall thereby defining a plurality of associated first and second contact sections connected by a continuous conductive surface extending therebetween; whereby said plurality of first and second molded sections are adapted to interconnect a plurality of first and second contact means in engagement with corresponding ones of said plurality of said first and second contact sections respectively.

6. The connector of claim 5 wherein said plurality of first molded sections including respective arcuate free ends convex in a first lateral direction along said first surface portion.

7. The connector of claim 6 wherein said continuous conductive surface includes the plated convex surface of said arcuate free ends of said first molded sections, said first molded sections defining respective spring beams deflectable at said arcuate free ends in a second direction opposed from said first direction upon deflectable engagement with corresponding contact means of a mating electrical article, said at least one plating layer providing mechanical strength at least to said arcuate end of said spring beam thereby reducing the stress relaxation of said spring beam.

8. A molded electrical connector comprising:

dielectric housing including a transverse wall having at least one aperture extending therethrough from a first to a second side thereof;

at least one first molded section extending outwardly from said first side of said wall and extending from the periphery of a respective said aperture; and at least one second molded section extending outwardly from said second side of said wall and extending from the periphery of said aperture, each said first and second molded section being associated with each other and including first surface portions extending continuously from a common sidewall of said respective aperture;

each said first and second molded sections including an inner dielectric core integrally molded with said wall of said housing, at least said first molded section including an arcuate free end convex in a first lateral direction along said first surface portion, and at least one layer of plating disposed on said first surface portions of said first and second molded sections and along said common sidewall thereby defining first and second contact sections connected by a continuous conductive surface extending therebetween with said first contact section including the plated convex surface of said arcuate free end of said first molded section; and said first molded section defining a spring beam deflectable at said arcuate free end in a second direction opposed from said first direction upon deflectable engagement with corresponding contact means of a mating electrical article; whereby said first and second molded sections are adapted to interconnect first and second contact means in engagement with said first and second contact sections respectively, said at least one plating layer providing mechanical strength at least to said arcuate end of said spring beam thereby reducing the stress relaxation of said spring beam.

9. The connector of claim 1 wherein said at least one layer of plating comprises a nickel-iron alloy.

* * * * *